US005668781A

United States Patent [19]

Jeannet et al.

[11] Patent Number: 5,668,781

[45] Date of Patent: Sep. 16, 1997

[54] ANALOG ELECTRONIC TIMEPIECE HAVING A MULTIFUNCTIONAL CALENDAR DISC

[75] Inventors: Nicolas Jeannet, Bôle; Pierre Schmidli, Bienne, both of Switzerland

[73] Assignee: Eta SA Fabriques d'Ebauches, Grenchen, Switzerland

[21] Appl. No.: 615,842

[22] Filed: Mar. 14, 1996

[30] Foreign Application Priority Data

Mar. 28, 1995 [CH] Switzerland ..... 00 871/95

[51] Int. Cl.[6] ..... G04B 19/24

[52] U.S. Cl. ..... 368/28; 368/37

[58] Field of Search ..... 368/28, 34, 35, 368/37, 77, 76, 80, 223, 221, 233

[56] References Cited

U.S. PATENT DOCUMENTS

| | | | |
|---|---|---|---|
| 3,760,585 | 9/1973 | Wein | 58/58 |
| 4,266,288 | 5/1981 | Berney | 368/28 |
| 4,398,832 | 8/1983 | Maire et al. | 368/76 |
| 4,733,384 | 3/1988 | Meister et al. | 368/28 |
| 4,815,051 | 3/1989 | Schmidli | 368/37 |
| 5,058,084 | 10/1991 | Riesen | 368/28 |
| 5,299,177 | 3/1994 | Koch | 368/73 |
| 5,446,702 | 8/1995 | Mossuz et al. | 368/37 |

FOREIGN PATENT DOCUMENTS

| | | |
|---|---|---|
| 0 366 610 | 5/1990 | European Pat. Off. . |
| 996 795 | 12/1951 | France . |
| 2 605 118 | 4/1988 | France . |
| 557 052 | 3/1974 | Switzerland . |
| 663 512 | 12/1987 | Switzerland . |
| 93/25942 | 12/1993 | WIPO . |

OTHER PUBLICATIONS

Berney J C "Quelques Variations sur la Base des Mouvements eta de la Series 251" 1 Jan. 1992, Jahrbuch der Deutschen Gesselschaft fur Chronometrie, vol. 43, pp. 135–137.

*Primary Examiner*—Vit W. Miska

*Attorney, Agent, or Firm*—Griffin, Butler, Whisenhunt & Kurtossy

[57] ABSTRACT

An analog electronic timepiece also having a display (4) for at least two other items of time information comprising a timekeeping circuit delivering a daily signal $S_j$ to a perpetual calendar circuit delivering, in response to a command signal $S_k$, an order signal $S_c$ representing the ranking occupied by the information on the display (4), and a disc signal $S_D$ representing the value of the instantaneous ranking of the time information displayed, in which a comparator-subtractor analysing the signals $S_c$ and $S_D$ in recurring manner delivers a signal $S_R$ modifying the display (4) until $S_D=S_C$, said display (4) having at least two distinct zones (4a, 4b) provided with different symbols occupying successive rankings.

9 Claims, 3 Drawing Sheets

ANALOG ELECTRONIC TIMEPIECE HAVING A MULTIFUNCTIONAL CALENDAR DISC

FIELD OF THE INVENTION

The instant invention relates to an analog electronic timepiece having a multifunctional calendar disc permitting the display, in addition to the current time, of at least two other items of time information by means of different symbols carried by the same moving or fixed disc.

Apart from the first function of a timepiece, which is to indicate the current time, there is very often also a need to have other time information such as the day of the month, the number of the annual cycle or the name of the current month.

DESCRIPTION OF THE PRIOR ART

To supply time information of this type, timepieces are already known having a revolving disc divided into 31 consecutive positions representing the days of the month, some of said positions also being able to provide on request time information other than the day of the current month. A timepiece of this type is in particular described in Swiss patent 663 512. In this document, the embodiment given by way of example relates more particularly to a timepiece in which the clock signal of the timekeeping circuit is used by a management circuit of a perpetual calendar circuit comprising counters for the days, the months and the years making it possible to control the rotation of a disc of the days of the month up to one of the twelve first positions corresponding to the number of the current month. According to other embodiments, it is also intended to use the first seven positions to indicate the number of the day of the week or the four first to indicate the number of the annual cycle in a cycle of four years. A device of this kind has the advantage of constituting a mechanical construction that is simpler than previously known devices in which the various items of time information were displayed by means of dials, disks or different crowns.

This device does, however, have the disadvantage for an only moderately attentive user of leaving him uncertain as to the information he reads since, for example, the same number 11 can just as well represent the 11th day of any month as the 11th month of the current year.

Timepieces are also known having a disc or crown divided into more than 31 equal sectors. European patent 0 366 610 describes for example a watch provided with a crown divided into 52 equal sectors to indicate the ranking of the week of the current year. By analogy, Swiss patent 557 052 describes a watch having a disc divided into equal sectors numbered from 1 to 49. Devices of this kind would present the same disadvantages as those previously described if one were to consider using some of these positions to display a different item of time information.

Finally, several documents describe devices in which the days of the month occupy 31 positions on a crown comprising 35 equal sectors adapted to be aligned with 35 equal sectors of a different crown on which are inscribed the days of five consecutive weeks. The four sectors left free by the days of the month are not used for any other time function. Timepieces of this kind are for example described in French patent 996 795 and Swiss patent 667 965. By analogy, U.S. Pat. No. 3,760,585 describes a timepiece in which 9 positions are left free between the days of the month having the numbers 1 and 31.

In French patent 2 605 118, four zones are occupied by symbols representing the four series of the 12 months of the year and four other zones corresponding to 12 forbidden steps and that consequently do not deliver any time information.

As may be seen, the time indicators disclosed in the prior art may make it possible to display more than one category of items of time information, but only by means of symbols of the same nature, regularly spaced around the entire or around part of a disc, with the risk of possible confusion regarding the nature of the information displayed, the zone possibly devoid of symbols providing no additional time information.

BRIEF SUMMARY OF THE INVENTION

The instant invention is directed at overcoming the disadvantages of this prior art by providing a timepiece in which the calendar disc has at least two display zones bearing symbols of different types to make it possible to display on request, at least two different categories of time information clearly and without risk of confusion.

BRIEF DESCRIPTION OF THE INVENTION

A timepiece according to the invention consequently has a first display for the current time by means of hands driven by a motor $M_1$, and a second display by means of a disc and an indicator that are movable in relation to one another by means of a second reversible stepping motor $M_2$ to display at least two other items of time information.

The timepiece comprises:

- a time-keeping circuit and a driving circuit for the motor $M_1$ to display the time delivering a day signal $S_j$,
- a circuit for interpreting the manipulations of an exterior command means delivering a signal $S_k$ representing one or several items of time information that have to be displayed
- a management circuit of a perpetual calendar comprising a first unit designated a "master block" and, a second unit designated a "slave block".

The master block is provided with calendar counters and a multiplexer, and delivers in response to the signals $S_j$ and $S_k$ an order signal $S_c$ representing the ranking of said information on the second display.

The slave block is provided with a counter delivering to a comparator-subtractor a disc signal $S_D$ representing the value of the instantaneous ranking of the time information currently displayed,

DETAILED DESCRIPTION OF THE INVENTION

The instant invention is characterised in that the comparator-subtractor also receives the order signal $S_c$ and delivers at its output a signal $S_R$ making it possible both to define the direction of rotation of a step motor of the motor $M_2$ by means of an attack circuit and to increase or to decrease the counter of the slave block in recurring manner until the disc signal $S_D$ is equal to the order signal $S_c$. In other words, the mobile element of the second display is displaced until $S_D=S_c$, that is until the time information called up is displayed.

The invention is also characterised in that the second display has at least two distinct zones provided with different symbols for each category of items of time information, the symbols of said zones occupying successive rankings on said display.

The second display can consist of a rotatable disc bringing the symbols opposite an aperture, or of a hand moving opposite symbols carried by a fixed disc.

In the foregoing, "calendar disc" must be understood in the broad sense, i.e. as designating a disc having any number of positions. However according to a preferred embodiment one of the zones has 31 positions for the serial numbers of the day in the month.

A single timepiece according to the invention could for example have 35 positions making it possible to the display the day of the month in Arab numerals on 31 positions and the number of the annual cycle in roman numerals on the 4 following positions, or 38 positions making it possible to display the day of the month and the day of the week using one or several letters, or also 50 positions making it possible to display the day of the month, the day of the week and the name of the month. Depending on the design of the interpretation circuit, these different items of time information could be called up by successive pressures, for example, on the crown, or by a single pressure making it possible to trigger said items of time information according to a predetermined order with an automatic return to a preferred time information, such as the day of the current month. The duration of the display of each item of time information is regulated by a time delay relay incorporated into said interpretation circuit.

The invention will be better understood with reference to the appended drawings corresponding to two embodiments given by way of non-limiting example, in which FIG. 1 shows diagrammatically a watch according to the invention giving the day of the month and the number of the annual cycle;

Figure 1:
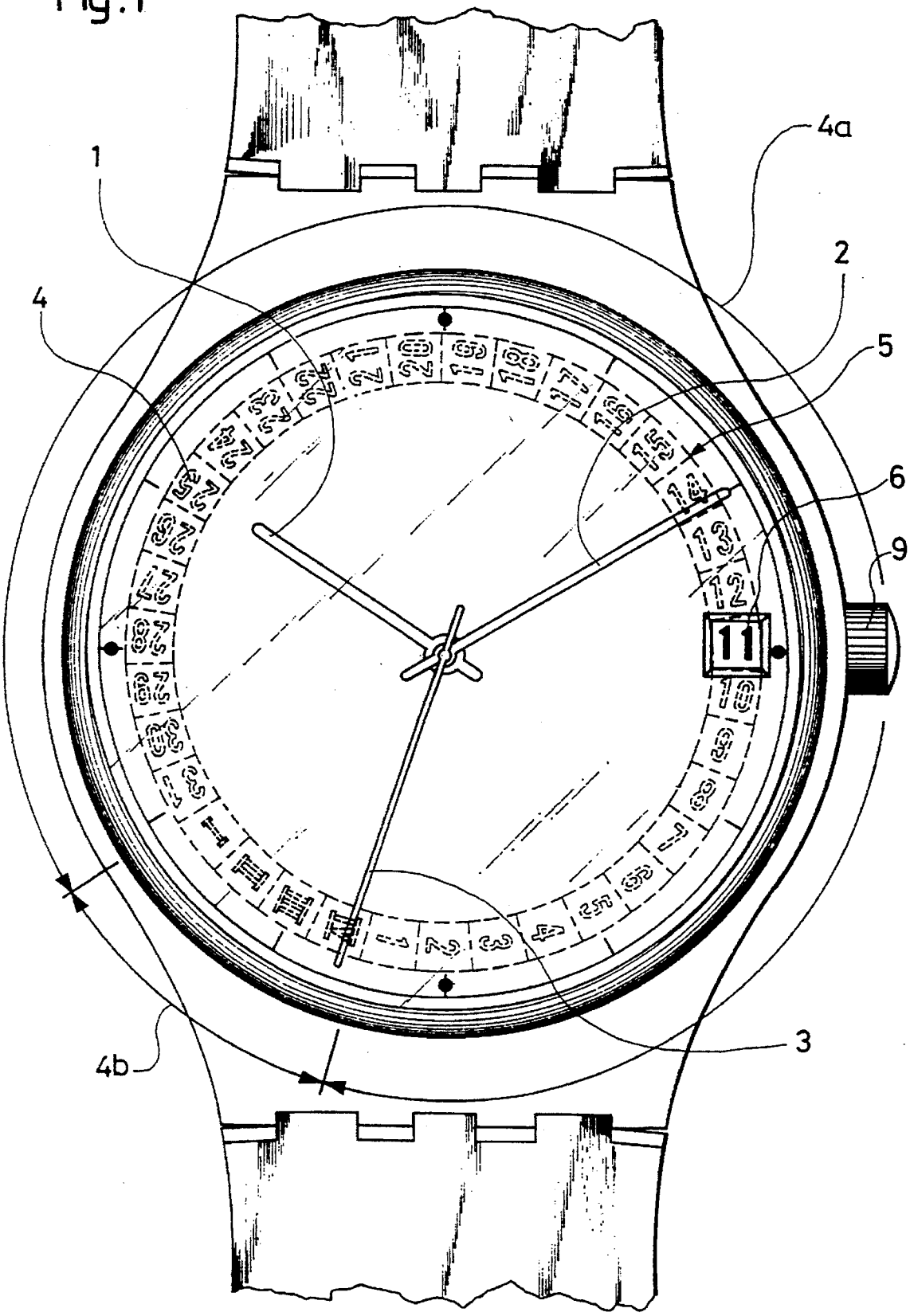

As may be seen in FIG. 1, a watch according to the invention has a first permanent display, a second display that can be modified on demand and at least one external command means. The permanent display is composed in conventional manner of an hour hand 1, a minute hand 2 and a second hand 3, driven by a conventional watch movement by a motor $M_1$ in a single direction. The display on demand is composed of a disk of the days of the month 5 having a display 4 with a total of 35 regularly spaced positions and capable of being brought opposite an aperture 6 by means of a reversible motor $M_2$, controlled by a management circuit of a perpetual calendar. The display 4 is divided into two zones 4*a* and 4*b* having respectively Arab numerals from 1 to 31 for the consecutive serial numbers of the day of the month and roman numerals I, II, III and IV for the position of the current year in a cycle of 4 years. In the watch shown, the command means is composed of the crown on which pressure can be exerted. Brief pressure makes it possible to replace in the aperture the display of the day of the month 11 by the number of the annual cycle, for example "III", a new pressure returning the display to its initial state "11". By successively exerting brief pressure twice, the display of the annual cycle "III" is displayed for a predetermined duration, for example 8 seconds, and the disc automatically returns to the preferred display of the day of the month "11". The crown also makes it possible to effect, by means of the appropriate manipulations, the correction of the items of time information and the manual resynchronisation of the horometric indicator in the event of loss of motors steps, should the timepiece not be provided with automatic resynchronisation, for example by means of a contact established when the first position is being displayed.

Figure 2:
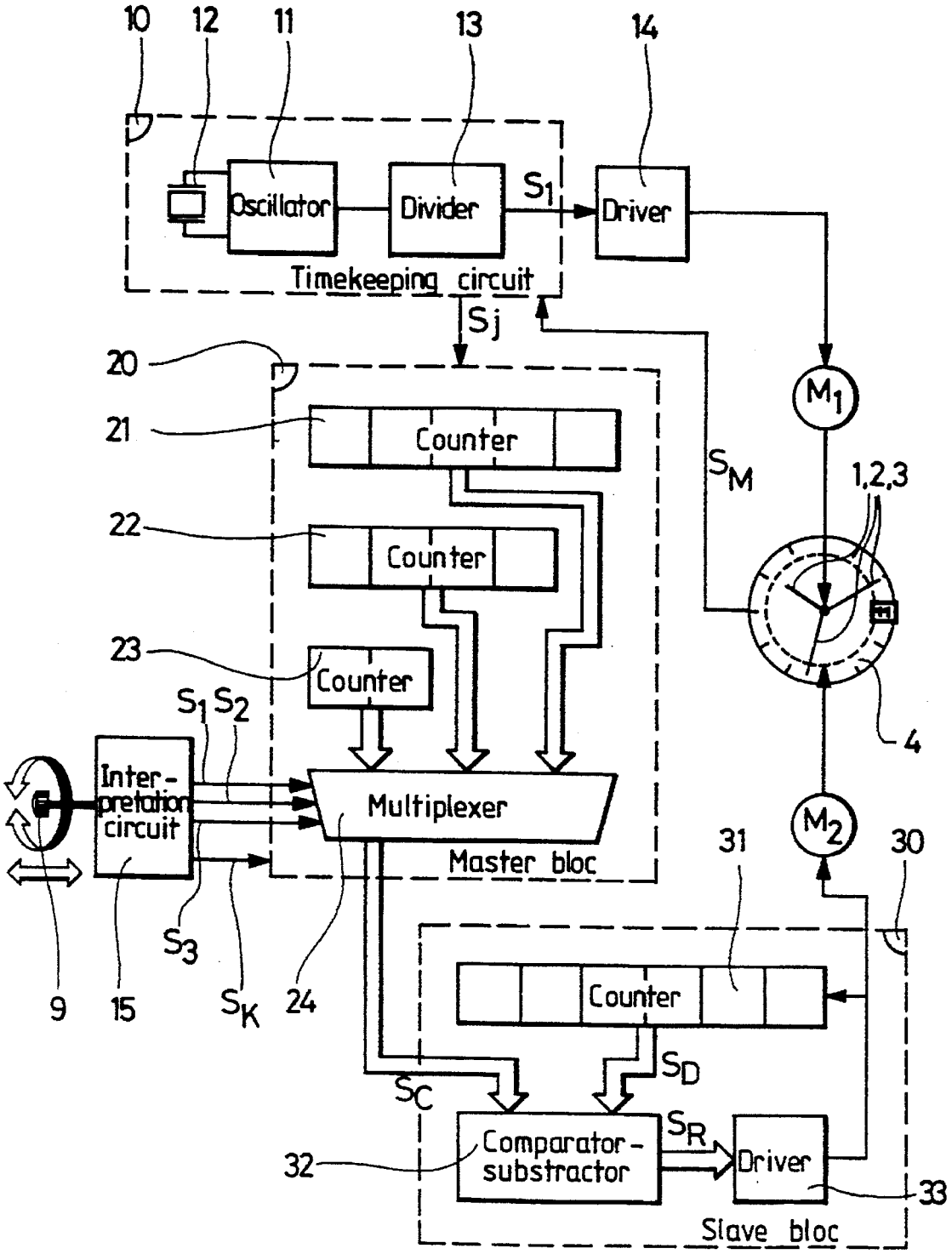
FIG. 2 shows the circuit diagram of the watch of FIG. 1.

The electronic circuit shown in FIG. 2 shows diagrammatically the components of the three modules needed for the operation of a timepiece of the invention. The first module is a timekeeping circuit 10, and the second module 20 (master block) forms a perpetual calendar circuit together with the third module 30 (slave block).

The timekeeping circuit 10 comprises in a manner known per se, an oscillator 11 frequency stabilised by a quartz resonator 12 supplying a signal, for example of 32768 Hz to a frequency divider 13. The frequency divider 13 delivers a first signal $S_1$ for the driver 14 commanding a first motor $M_1$ driving the hands 1, 2, 3 of an analog display. It also delivers a second daily signal $S_j$ adapted to increase by increments the master block 20.

The signal $S_j$ can also be obtained by treating a signal $S_M$ emitted by a mechanical contact linked to the drive of the hands, said contact closing every 12 hours.

The master block 20 comprises binary counters 21, 22, 23 assembled in conventional manner (not shown) for the days of the month (5 bits), the months (4 bits) and the years (2 bits). It also receives via the intermediary of an interpretation circuit 15 manipulations effected at the crown 9, a signal $S_k$ representing the time information that has to be displayed by the rotating disc 5. As a function of the signal $S_k$ received, the contents of the counters 21, 22 and 23 are read in a multiplexer 24 which delivers at its output a signal $S_c$ representing a value termed "order value" intended for the "slave block" 30. This order value is representative of the ranking occupied by the time information corresponding to the signal $S_k$ on the display 4 of the disc 5.

The slave block 30 comprises a disc counter 31 in which the last position displayed in the aperture 6 is memorised. The counter 31 has as many bits as are necessary to memorise all the positions of the disc. In this example, the counter 31 thus has 6 bits for the 35 positions 1 to 31, I to IV, the positions I to IV thus being represented in the counter by the rankings 32 to 35. At its output, the counter 31 delivers a signal $S_D$ representative of the disc value. The signals $S_c$ and $S_D$ are read in a comparator-subtractor 32 which delivers at its output a signal $S_R$ which determines the direction of rotation of the second motor $M_2$, driven by a step motor via the intermediary of the driver 33. The signal $S_R$ will also make it possible to increase or decrease the counter 31 which will thus contain a new value of the disc. The same operation will continue in recurring manner until the value of the disc is equal to the order value. In other words, the signal $S_R$ will be at the level 0 and the motor $M_2$ will no longer receive a motor impulse.

The circuit diagram that has just been described also shows signals $S_1$, $S_2$, $S_3$ emitted by the interpretation circuit 15 towards the multiplexer 24 to effect corrections in the perpetual calendar circuit if necessary. It will also be noted that it is not necessary to interpose a decoder between the counter 23 of the annual cycle of 2 bits and the multiplexer 24, as would be the case in the device of above-mentioned Swiss patent CH 663 512 if one wished to use the 31 positions of the days of the month to display the annual cycle. The invention consequently permits a simplified design in this respect.

Reverting to the example of FIG. 1, in which the disc has 35 positions, the reference value of the comparator-subtractor 32 serving to determine the shortest route is |18|. The display indicates the 11th day of a month, that is a disc value equal to 11. Pressure on the crown calls up the number of the annual cycle, supposed equal to III that corresponds to an order value of 34 and the difference 34–11=23 is compared in the comparator-subtractor to |18|. This difference being greater than |18|, the signal SR will pass to the level −1 to drive the disc from one position in the anti-clockwise direction. The new disc value will then be 10 in the counter 31. The new disc value will again be subtracted from the unchanged order value and the operation will continue in recurrent manner until the disc value is equal to the order value and the rotation of the disc is stopped to display III. The commanded or automatic return to the display of the day of the month is effected according to a comparable process starting with order and disc values which will be $S_c$=11 and $S_D$=34 respectively.

In the foregoing it has been implicitly assumed that the number of teeth of the wheel driving the disc was the same as the number of positions, but it follows that the attack circuit 33 can be adapted to make the motor $M_2$ execute as many steps as are necessary to pass from one position on the disc to the following position. In equivalent manner, the multiplexer 24 could be modified to take into account the position occupied by the symbols of each zone on the display.

Figure 3:
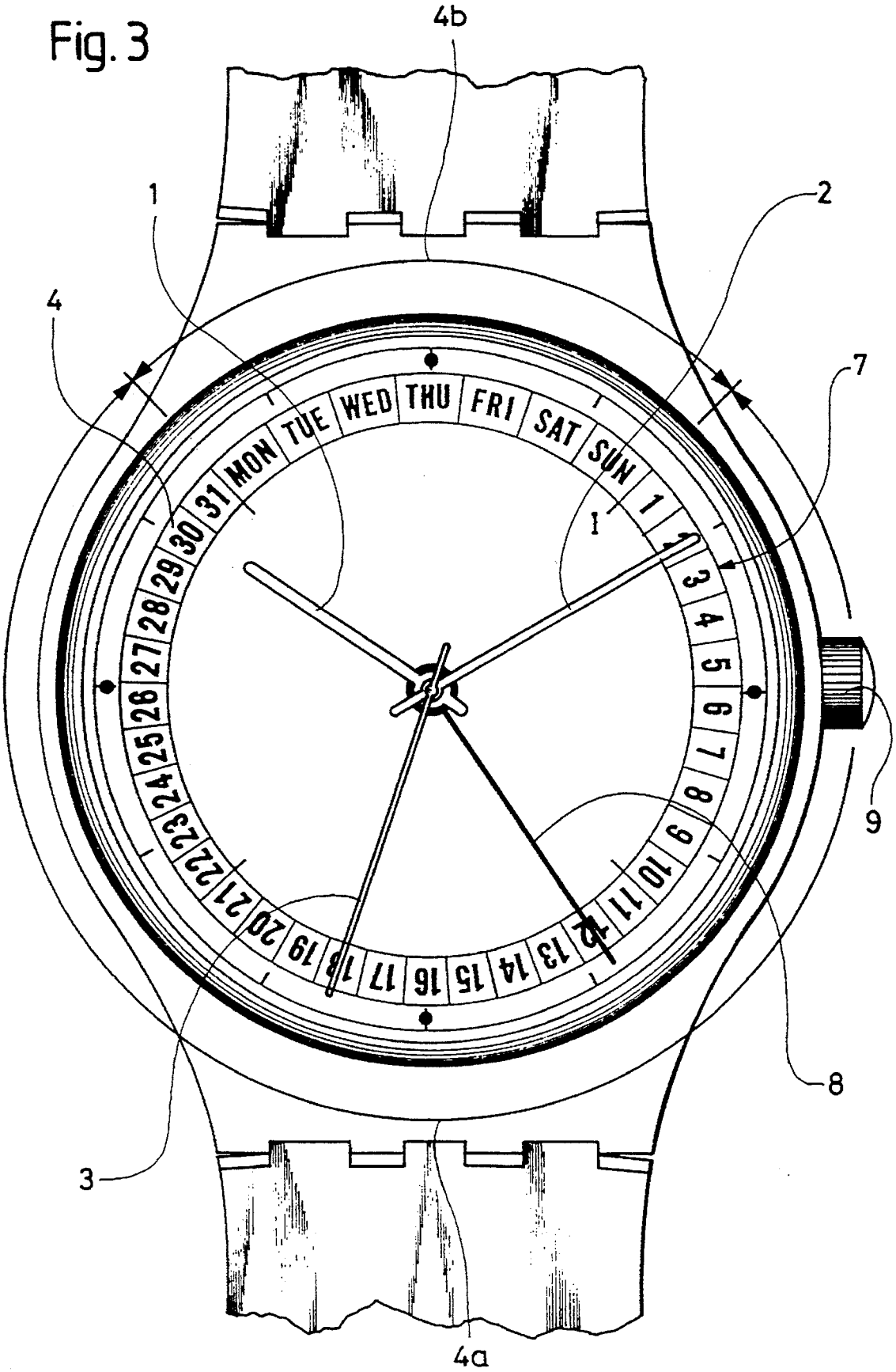
FIG. 3 shows diagrammatically a second embodiment of a watch according to the invention showing the day of the month and the day of the week.

FIG. 3 represents another example of a timepiece according to the invention comprising 38 useful positions, provided with a fixed disc 7 and an indicator 7 composed of a central hand 8. The display 4 is divided into two zones 4*a* and 4*b* corresponding respectively to 31 positions for the days of the month and to 7 positions for the days of the week represented by their three first letters. The angular sectors of the positions of the zone 4*b* being larger than those of the positions of the zone 4*a*, the toothed drive wheel will, for example, have 83 teeth, with the result that one position of the zone 4*a* corresponds to 2 teeth and that one position of the zone 4*b* corresponds to 3 teeth. In the electronic circuit of FIG. 2, the master block 20 has an additional counter for the 7 days of the week and the multiplexer 24 is modified so that the order signal $S_c$ takes account of the number of different steps in each zone.

It goes without saying that the examples that have just been described can also incorporate the prior technologies. In the example shown in FIG. 1, it is for example possible to have the display of the number of the month on the 12 first positions of the day of the month, in addition to the display of the day of the month and of the annual cycle. Similarly, if this is imposed by technical or aesthetic reasons, it is possible, while still having at least two zones having time information of different kinds, to have one or several different zones that do not have any time information.

Other modifications or adaptations can be added by the person skilled in the art without departing from the framework of the instant invention.

What is claimed is:

1. An electronic analog timepiece for displaying time by means of hands driven by a motor $M_1$, and displaying at least two other items of time information by means of a second display having a disc and indicator, one of which is movable relative to the other by means of a second, reversible stepping motor $M_2$, said timepiece comprising:

a time-keeping circuit and a driving circuit for driving the motor $M_1$ to display the time delivering a daily signal $S_J$;

an exterior control means for selecting a category of time information to be displayed;

an interpretation circuit for interpreting manipulations of the exterior control means and delivering a signal $S_K$ representing the selected category of time information;

a management circuit for a perpetual calendar comprising on the one hand a master block, provided with calendar counters and a multiplexer, and delivering in response to the signals $S_J$ and $S_K$ an order signal $S_C$ representative of the ranking of said information on the display, and also comprising a slave block provided with a comparator-subtractor and a counter delivering to the comparator-subtractor a disc signal $S_D$ representing the value of the instantaneous ranking of the time information displayed, wherein the comparator-subtractor also receives the order signal $S_C$ and delivers at its output a signal $S_R$ making it possible both to define the direction of rotation of the motor $M_2$ by means of a driving circuit and to increase or decrease the counter in a recurring manner until $S_D$=$S_C$, and in that the second display has at least two distinct zones provided with different symbols for each category of time information, the symbols of said zones occupying successive rankings on said display.

2. A timepiece according to claim 1, wherein said second display is composed of a rotatable disc bringing the time symbols opposite an aperture.

3. A timepiece according to claim 1, wherein said second display is composed of a hand that moves opposite time symbols carried by a fixed disc.

4. A timepiece according to claim 1 wherein the interpretation circuit also has a temporiser making it possible to display a new item of time information for a predetermined duration, or several items of time information successively for predetermined periods.

5. A timepiece according to claim 1 wherein the angular time-lag of each symbol is the same in all the display zones.

6. A timepiece according to claim 1 wherein the angular time-lag of the time symbols differs from one display zone to the other.

7. A timepiece according to claim 1, wherein one display zone corresponds to the days or the month and one or several other zones correspond to the names of the days of the week, to the names of the months of the year or to the number of the annual cycle.

8. A timepiece according to claim 7 wherein the display of the days of the month also makes it possible to display a second item of time information in this same zone.

9. An electronic analog timepiece for displaying time by means of hands driven by a motor $M_1$, and also displaying at least two other items of time information by means of a second display having a disc, an indicator and a reversible stepping motor $M_2$ for moving one of said disk and indicator relative to the other, said timepiece comprising:

a time-keeping circuit producing a first signal for driving said motor $M_1$ to display the time, said time-keeping circuit also producing a daily signal $S_J$ once each day;

a manually actuated exterior control means for selecting a category of time information to be displayed;

an interpretation circuit responsive to manipulations of the control means for producing a signal $S_K$ representing the selected category of time information; and, a perpetual calendar management circuit comprising, a plurality of calendar counters responsive to said daily signal $S_J$, a multiplexer connected to said calendar counters and responsive to said signal $S_K$ for producing an order signal $S_C$ representative of the ranking of an item of information being displayed on said second display, a reversible counter for producing a disc signal $S_D$ representing a current position of one of said disc and said indicator, and, a comparator-subtractor responsive to said order signal $S_C$ and said disc signal $S_D$ for applying a recurring signal $S_R$ to said reversible motor $M_2$ and said reversible counter until said disc signal $S_D$ is equal to said order signal $S_C$, said recurring signal $S_R$ incrementing a count in said reversible counter and stepping said reversible motor $M_2$ in a first direction when $S_D>S_C$ and decrementing a count in said reversible counter and stepping said reversible motor $M_2$ in a second direction when $S_D<S_C$, said disc having thereon a plurality of distinct zones corresponding to a plurality of categories of time information, each zone having therein a plurality of symbols representing items of time information, the symbols of said zones occupying successive rankings on said disc and the symbols in each zone being different.

* * * * *